United States Patent [19]

Spencer

[11] 4,085,967

[45] Apr. 25, 1978

[54] OPERATORY STOOL WITH CLUTCH FOR REST MEMBER

[75] Inventor: Bruce J. Spencer, Spring Grove, Pa.

[73] Assignee: Dentsply Research & Development Corporation, Milford, Del.

[21] Appl. No.: 821,267

[22] Filed: Aug. 3, 1977

[51] Int. Cl.[2] ..... A47C 13/00

[52] U.S. Cl. ..... 297/115; 297/365; 297/417

[58] Field of Search ..... 297/115, 116, 417, 411, 297/429, 431, 406, 365; 248/281, 280, 421

[56] References Cited

U.S. PATENT DOCUMENTS

| | | | |
|---|---|---|---|
| 247,350 | 9/1881 | Hofstatter, Jr. | 297/116 |
| 259,642 | 6/1882 | Hofstatter, Jr. | 297/116 |
| 1,050,672 | 1/1913 | MacIntosh | 248/281 |
| 2,844,193 | 7/1958 | Lauterbach | 297/116 |
| 2,858,876 | 11/1958 | Woodson, Jr. | 297/116 X |
| 3,189,383 | 6/1965 | Gniech | 297/365 |
| 3,338,626 | 8/1967 | Hamilton | 297/115 |
| 3,704,910 | 12/1972 | Willcott | 297/411 |
| 4,025,112 | 5/1977 | Hale | 297/411 |

*Primary Examiner*—James T. McCall
*Attorney, Agent, or Firm*—C. Hercus Just

[57] ABSTRACT

An operatory stool having an arcuate rest member supported above the seat by a pair of parallel upstanding support members pivotally connected to and between said rest and seat to permit lateral adjustment of said rest relative to said seat, and manually operable clutch mechanism on said rest member operable relative to the upper ends of said upstanding support members to maintain said rest member in a desired adjusted position relative to said seat.

11 Claims, 9 Drawing Figures

10
12
14
16
18
20
22
24
26
28
30
32
34
36
60

Fig. 6
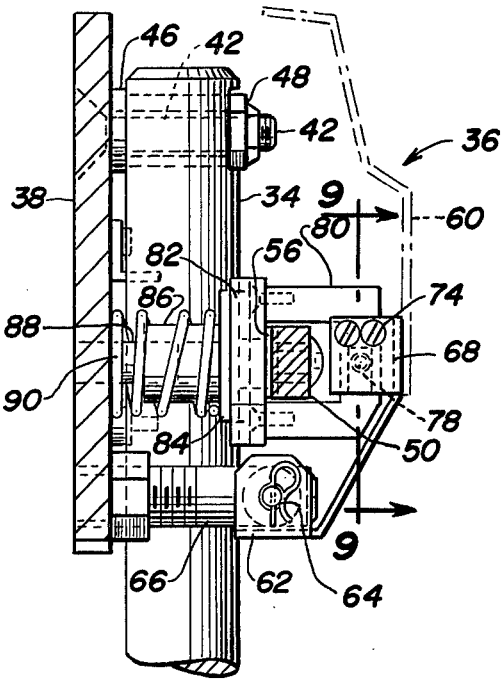
Fig. 7
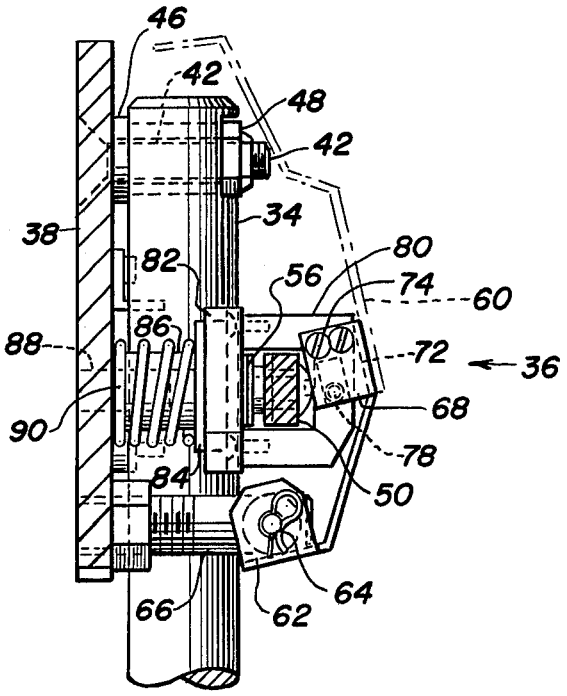
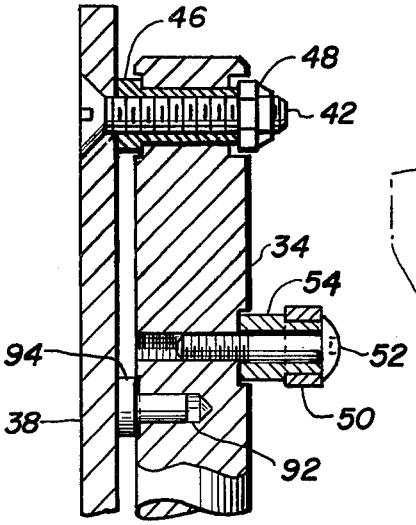
Fig. 8
Fig. 9
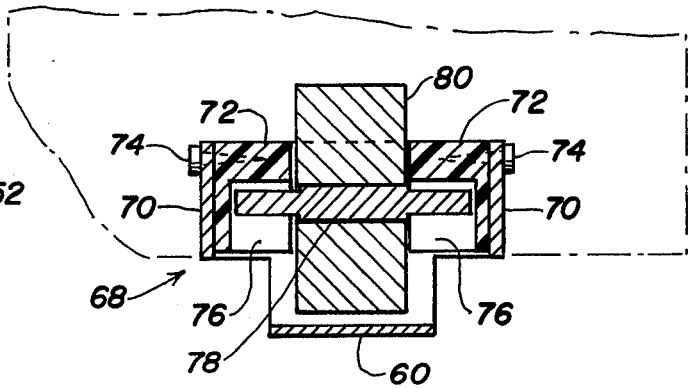

OPERATORY STOOL WITH CLUTCH FOR REST MEMBER

BACKGROUND OF THE INVENTION

The present invention pertains to an operatory stool of the type used by various branches of the medical arts and professions, such as dentists, ophthalmologists, and any other branch in which a medical professional or an assistant to said professional may be seated during professional operations. Such stools are mounted upon casters for ready mobility and the seat usually is vertically adjustable relative to base structure upon which the casters are mounted. At a location above the seat, a rest member is mounted upon one or more vertical post-like members which preferably are parallel to each other and the lower ends thereof are disposed in bearings supported by the seat. The rests may be of different shapes but, in general, are substantially arcuate and the same are upholstered to provide yieldability to a person occupying the seat and leaning against the rest for at least partial support thereby while performing professional operations.

To provide maximum comfort to a person occupying such stool, particularly in regard to leaning against said rest, it is customary to provide disengageable locking means operable to maintain the rest in a desired position of adjustment with respect to the seat, in either lateral or vertical directions. A typical example of such locking means is shown in U.S. Pat. No. 3,338,626, in the name of F. T. Hamilton, dated Aug. 29, 1967, and over which the present invention comprises an improvement.

For purposes of maintaining relative positions of arms or backs in various types of chairs, couches and the like, with respect to a seat, various types of releasable latch mechanisms have been employed, such as pivoted latch members having one end engageable with a series of notches disposed in an arcuate pattern. Examples of such adjusting means are shown in U.S. Pat. Nos. 247,350, dated Sept. 20, 1881, and 259,642, dated June 13, 1882, both in the name of Hofstatter, Jr.; and also in U.S. Pat. No. 1,334,365, dated Mar. 23, 1920, in the name of Freeman; and U.S. Pat. No. 1,663,864, dated Mar. 27, 1928, in the name of Russell.

Means for maintaining a pivoted back of a chair in various angular positions with respect to a seat and comprising a notched rod movable longitudinally in said seat and engageable by a spring-pressed pawl operated manually by a lever below the seat is illustrated in U.S. Pat. No. 879,489, dated Feb. 18, 1908, in the name of Pokorny.

For purposes of strength, durability, maintenance of desired adjusted positiones, notwithstanding the exertion of substantial physical forces against the rest of an operatory stool of the type to which the present invention pertains, as well as minimizing the possibility of repairs being required, the present invention has been devised, particularly to provide clutch mechanism of a different type from that shown in the aforementioned prior art, the details and advantages of which are set forth below.

SUMMARY OF THE INVENTION

It is one of the principal objects of the present invention to provide an operatory stool in which a preferably arcuate rest is supported by a pair of parallel upstanding support members pivotally connected at the lower ends thereof to the seat of the stool and the upper ends of said members are pivotally interconnected to said arcuate rest member to afford lateral adjustment of the rest member relative to the seat, the maintenance of an adjusted position of the rest member being maintained by clutch mechanism supported by the rest member and operable by the application of minimum physical force to disengage the clutch members to permit lateral adjustment of the rest member relative to the seat and also effect instantaneous re-engagement of the clutch member when the mechanism is released by the operator.

Another object of the invention is to devise the clutch mechanism in the form of one clutch member being elongated and extending between the upper end portions of the upstanding support members and the other clutch member being movable toward and from said elongated clutch member, said other clutch member being supported by said rest member and spring-type pressure means being employed to move said one clutch member toward the other.

A further object of the invention is to utilize coengageable vertical serrations respectively formed upon adjacent surfaces of said clutch members.

Still another object of the invention is to form the manually operable actuating means for the clutch mechanism in the nature of a lever-like member pivotally supported relative to one of said clutch members and interengageable with the other to move said other clutch member away from said one clutch member when disengagement thereof is desired for lateral adjustable movement of the rest member relative to the seat, said lever-like member being pivoted preferably at one end below said clutch members and extending above the same for engagement of the upper end portion of said member to effect separation of the clutch members.

One other object of the invention is to provide in the clutch mechanism, a connecting member extending across said other clutch member between the movable clutch member and said lever-like member, the intermediate portion of said lever-like member engaging said connecting member.

One further object of the invention ancillary to the foregoing object is to form said connecting member in a U-shaped configuration, the legs of the same being disposed horizontally and respectively above and below said elongated clutch member, said U-shaped connecting member being supported by a guide member projecting rigidly from said rest member and a supporting guide axially movable upon said aforementioned guide member is connected to the movable clutch member for reciprocation upon said guide member, spring means surrounding said guide member and supporting guide and operable to urge the movable clutch member normally toward the other clutch member to releasably maintain the same in clutching engagement with each other.

BRIEF DESCRIPTION OF THE DRAWINGS

FIG. 6 is a fragmentary vertical elevation as seen on the line 6—6 of FIG. 5 and in which the clutch members are shown in engagement with each other.

FIG. 7 is a view similar to FIG. 6, but showing the actuating member in the position thereof in which the clutch members are disengaged.

FIG. 8 is a further enlarged fragmentary vertical sectional view of a detail of the apparatus as seen on the line 8—8 of FIG. 5.

FIG. 9 is a fragmentary vertical sectional view of a further detail of the apparatus as seen on the line 9—9 of FIG. 6.

DETAILED DESCRIPTION

Figures 1, 2, 3:
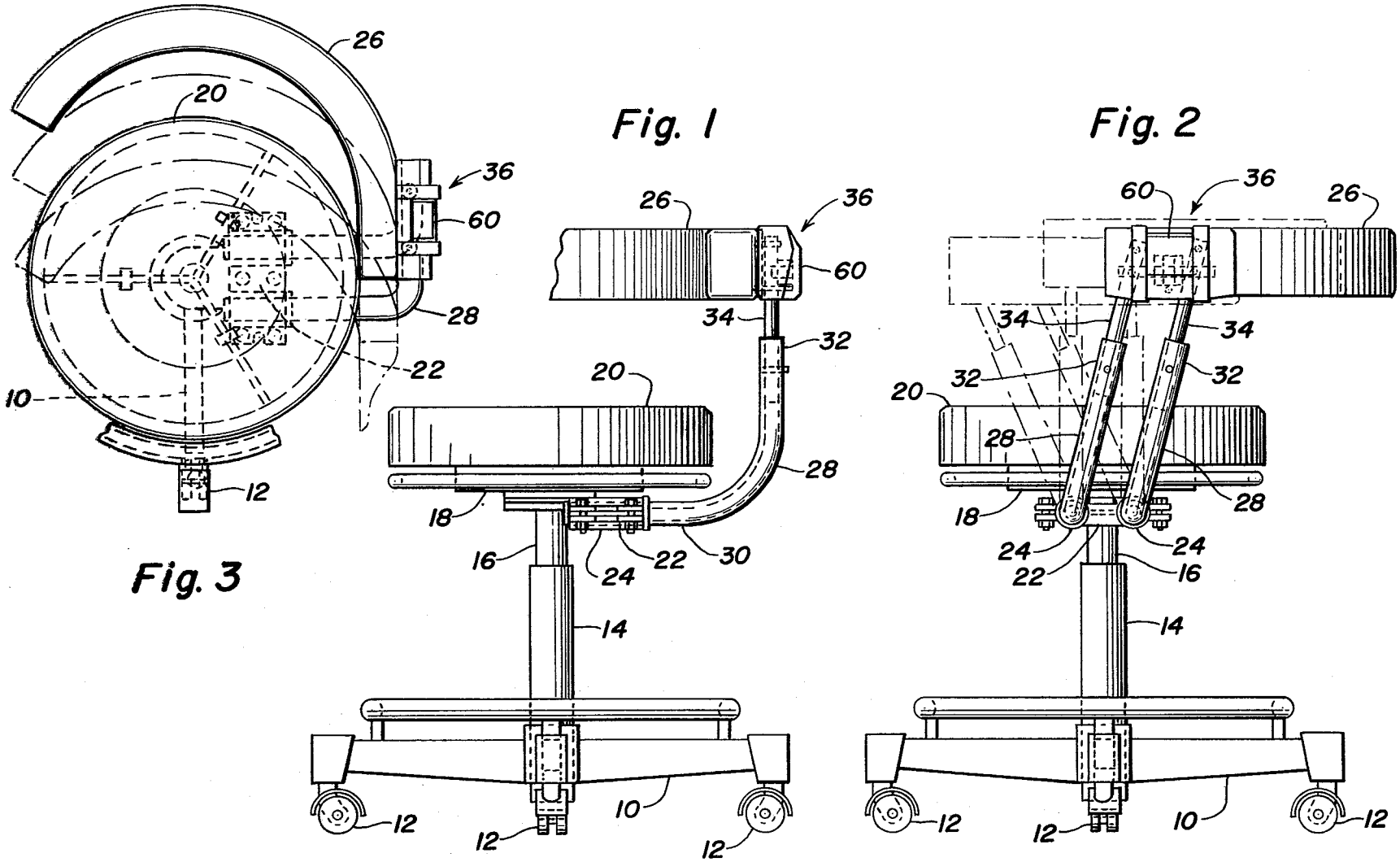
FIG. 1 is a side elevation of an exemplary operatory stool embodying the principles of the present invention.
FIG. 2 is a front elevation of the stool shown in FIG. 1 and illustrating in full lines one exemplary position of the rest member relative to the seat of the stool and several alternate phantom views of the rest member with respect to the stool are also illustrated.
FIG. 3 is a top plan view of the operatory stool shown in FIG. 1.

Referring to FIGS. 1—3, it will be seen that the exemplary operatory stool illustrated therein comprises a base structure 10, which actually comprises a plurality of legs having casters 12 on the outer ends thereof. A post 14 extends upwardly from the base structure 10 for purposes of receiving a depending stem or shaft 16 which is provided on the upper end thereof with a mounting plate 18 that supports a cushion-type seat 20 on the upper surface thereof. The shaft 16 mounting plate 18 also support a bearing bracket 22 which is provided with a pair of horizontal, parallel bearing sleeves 24.

Figure 4:
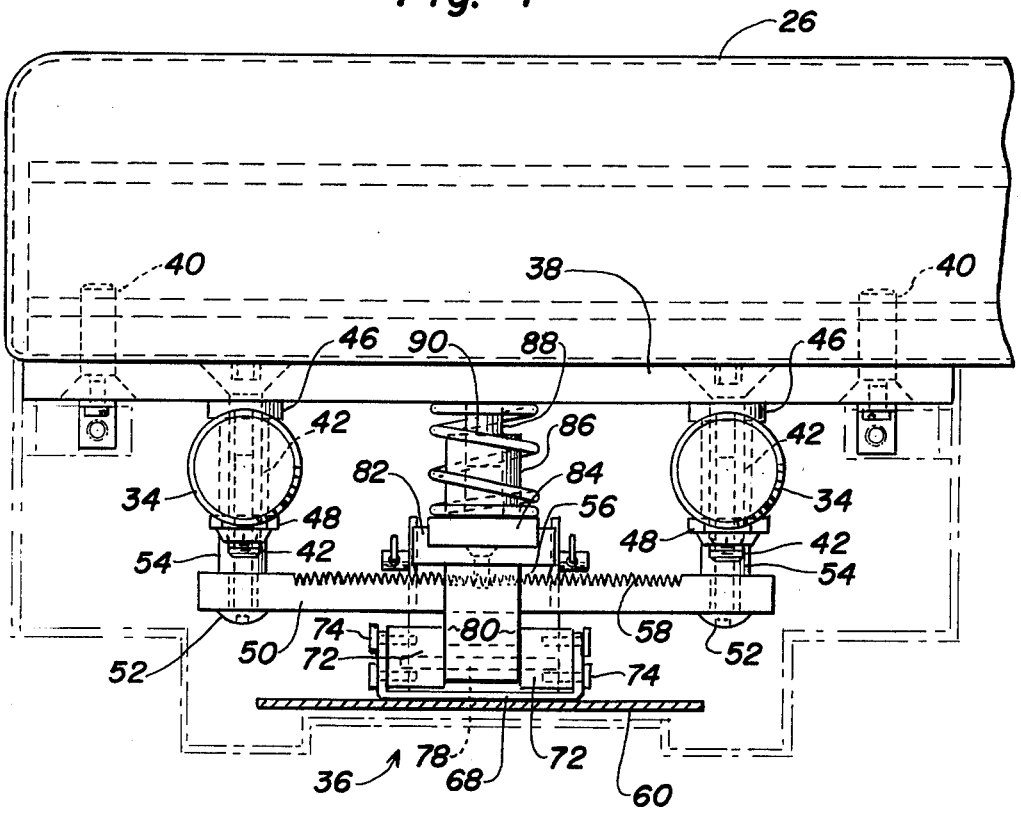
FIG. 4 is a fragmentary view on a larger scale than employed in the preceding figures and illustrating position-maintaining means for the rest member with respect to the upstanding support members for the rest member, said view illustrating in phantom a combination lever-like actuating member and shield means for the clutch mechanism.

The stool to which the present invention pertains also includes an arcuate rest member 26 which is preferably upholstered to provide a cushion effect for the operator when leaning against the same. The arcuate rest member is maintained preferably at all times in horizontal position and parallel to the seat 20, but the present invention provides for the support means for the rest member to be capable of permitting lateral adjustment of said member with respect to the seat 20. Said support means comprises a pair of parallel, substantially upright support members 28 which, for example, may be tubular and, in side elevation as shown in FIG. 1, are substantially L-shaped and include a horizontal lower portion 30, the terminal end portions of which are received within the bearing sleeves 24, and an upper end portion 32, which, for example, may have a short rod 34 fixed thereto and projecting from the upper end of the portions 32. The upper ends of the short rods 34 are pivotally connected to a position-maintaining unit 36, details of which are illustrated in different ways in FIGS. 4–9, and to which attention is now directed, as follows:

The unit 36 comprises a base plate 38 which is secured to the outer vertical surface of the rest 26, see FIG. 4, by suitable means, such as plurality of screws 40. Also, extending through base plate 38 are two additional short shafts which may be in the form of bolts 42, and upon which one-piece shouldered-bushings 46 are mounted with clamping nuts 48 for purposes of pivotally supporting the upper ends of the short rods 34 of support members 28.

Figure 5:
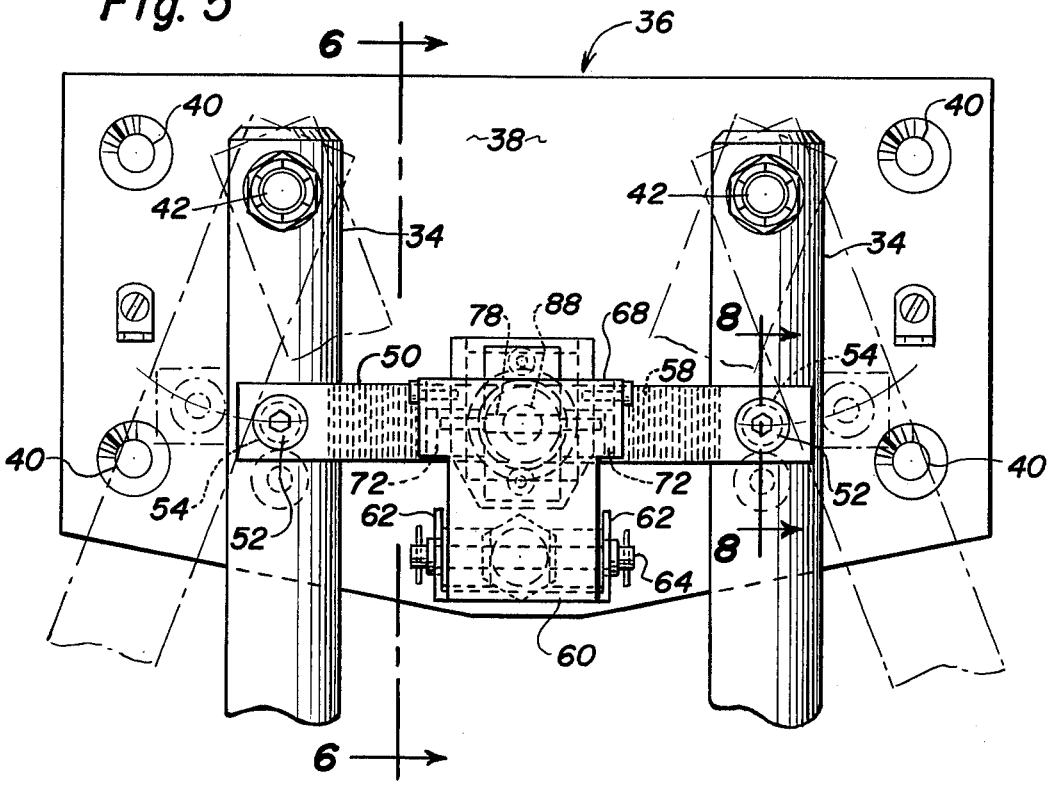
FIG. 5 is a vertical view of the mechanism shown in FIG. 4 and illustrating in phantom several alternate positions of the clutch mechanism relative to the upstanding supporting arms for the rest member.

One of the more salient objectives of the present invention is to provide simple but readily operable clutch means within the position-maintaining unit 36. Accordingly, said clutch means comprises an elongated first clutch member 50 which extends between and is pivotally connected to short rods 34 on the upper portions of the support members 28, adjacent collars 54, as best shown in FIGS. 4 and 5. Supporting pivot bolts or screws 52 extend through opposite ends of the clutch member 50 and are threaded with appropriate holes in said short rods 34 of support members 28, whereby it will be seen that the clutch member 50 is movable relative to base plate 38.

A companion, second clutch member 56, is supported by the base plate 38 in a manner to permit limited movement in the direction perpendicular to said plate but otherwise prevent any lateral movement thereof with respect to said base plate. Especially from FIG. 4, it will be seen that the abutting surfaces of the first and second clutch members 50 and 56 are provided with matching serrations 58, the same being of a relatively steep nature so as to minimize the possibility of the clutch members being cammed apart accidentally. Separation of the clutch members is effected by moving the second clutch member 56 inwardly toward base plate 38 by manually operable actuating means preferably comprising a lever-like member 60 which is shown best in FIGS. 6 and 7, partly in phantom. Said member preferably is formed from sheet metal and the lower end thereof has a pair of spaced vertical ears 62 which also are shown in FIG. 5, said ears being apertured to receive a pivot pin 64 which also extends through a supporting stud 66 which may be in the form of a bolt, one end of which is threaded into base plate 38 as clearly shown in FIGS. 6 and 7.

Intermediately of the opposite ends of the actuating member 60 is a U-shaped clevis 68 which is fixed to member 60, such as by welding. Each of the opposite arms 70 supports upon its inner surface an anti-friction, molded pin actuating block 72, secured thereto by a screw 74 and each of said blocks in the lower portion thereof has a central vertical slot 76 which respectively receives the opposite ends of a pivot pin 78 which extends through the intermediate portion of a U-shaped connecting member 80, which preferably is formed from metal.

Extending across the vertical inner face of the connecting member 80 and secured to the end faces of the legs thereof is a transverse plate 82, which is connected by two screws centrally thereof to the second clutch member 56, which, as can readily be seen from FIG. 4, is substantially shorter than the elongated clutch member 50. The inner face of the transverse plate 82 is recessed to receive a block 84, which has projecting from the inner face thereof a guide sleeve 86, which is mounted upon a fixed guide pin 88, secured suitably to base plate 38. Pressure means preferably in the form of a coiled spring 90 surrounds the guide sleeve 86 and opposite ends of said spring respectively abut the outer face of base plate 38 and the inner face of block 84. Said spring is of sufficient strength to capably maintain the serrations of the first and second clutch members 50 and 56 in firm engagement with each other but, when it is desired to separate the clutch members by moving clutch member 56 inwardly relative to elongated clutch member 50, it is only necessary for an operator to engage the upper portion of member 60 and move the same from the phantom position shown in FIG. 6 to that shown in FIG. 7, whereupon the rest 26 may be moved laterally in either direction as indicated in exemplary manner between the full line and broken line illustrations thereof in FIG. 2, it being understood that said respective positions are not intended to represent the opposite fullest extent to which the rest 26 may be moved.

Referring to FIG. 8, it will be seen that the short rod 34 is provided in its rear surface with a bore 92 which receives the stem of a molded button 94, which preferably is formed from self-lubricating, anti-friction plastic, such as Teflon, Delryn, or otherwise which slidably engages the outer surface of base plate 38 and thereby prevents the inner surfaces of the short rods 34 from frictionally contacting said base plate during any adjustable movement of the rest 26 with respect to seat 20.

From the foregoing, it will be seen that the present invention provides an operatory stool having an adjustable rest thereon which may be moved from one lateral position to another relative to the seat of the stool simply by pressing the upper end of actuating member 60 which moves the innermost clutch member with respect to the outer one, and thereby permits ready adjustment of the position of the rest which, when disposed in a newly desired position, may be maintained there simply by releasing the actuating member 60, whereupon spring 90 instantly restores the second clutch member 56 into engagement with the elongated first clutch member 60 and said position of the rest thereby is maintained against all reasonable force until a different position is desired by the user thereof. The various elements of the structure and particularly the position-maintaining unit 36 which includes the clutch members are rugged and durable and capable of long life. Further, they require no appreciable adjustment.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A stool having a seat supported by depending means engageable with a floor-like supporting surface, an arcuate rest member positioned above said seat and substantially parallel thereto, and a pair of upstanding parallel support members for said rest pivotally interconnected at the opposite ends thereof respectively to said seat and rest for laterally adjusted positioning of said rest relative to said seat, in combination with position retaining means between said rest and arms comprising: a pair of co-engageable clutch members respectively connected to said rest and upper ends of said support members, pressure means normally urging said clutch members releasably into clutching engagement, and manually operable actuating means connected to one of said clutch members and operable to effect sufficient disengagement of said clutch members to permit lateral movement of said rest member relative to said seat.

2. The stool according to claim 1 in which said support members are substantially L-shaped arms arranged with one end extending laterally from the other end which is disposed generally in upstanding manner, bearings carried by said seat, and said one end of each of said arms being rotatably mounted in said bearing for adjustable support thereby.

3. The stool according to claim 1 in which one of said clutch members is elongated and extends substantially horizontally between the upper end portions of said support member and the other clutch member being movable toward and from said elongated clutch member.

4. The stool according to claim 3 in which said rest supports said other clutch member, and said position maintaining means further including spring-type pressure means operable to press one of said clutch members toward the other.

5. The stool according to claim 4 in which co-engageable faces upon said clutch members contain mating vertical serrations respectively formed on said surfaces, said serrations being maintained releasably in engaging relationship by said spring-type pressure means.

6. The stool according to claim 4 in which said manually operable actuating means comprises a lever-like member pivotally supported relative to one of said clutch members and having a portion thereon interengageable with the other clutch member to move the other clutch member away from said one clutch member to disconnect said clutch members.

7. The stool according to claim 6 in which said lever-like member is pivoted at one end below said clutch members and has a portion extending above the clutch members for engagement with said other clutch member and operable to effect separation of said clutch members as aforesaid.

8. The stool according to claim 6 in which said movable clutch member is supported by a connecting member extending across one surface of said other clutch member and disposed between said movable clutch member said lever-like member.

9. The stool according to claim 8 in which said connecting member is engaged by an intermediate portion of said lever-like member.

10. The stool according to claim 9 in which said connecting member is substantially U-shaped and the legs thereof being disposed horizontally and respectively above and below said elongated clutch member.

11. The stool according to claim 6 in which said position-maintaining means further includes a guide member projecting rigidly from said rest member and a supporting guide on said movable clutch member being reciprocable upon said guide member, and a spring surrounding said guide member and supporting guide arranged to urge said movable clutch member toward the other clutch member.

* * * * *